US006631669B2

(12) United States Patent
Weldle

(10) Patent No.: US 6,631,669 B2
(45) Date of Patent: Oct. 14, 2003

(54) CLOSING SPRING ASSEMBLY FOR A HANDGUN

(75) Inventor: Helmut Weldle, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/971,439

(22) Filed: Oct. 5, 2001

(65) Prior Publication Data

US 2002/0046644 A1 Apr. 25, 2002

Related U.S. Application Data

(63) Continuation of application No. PCT/EP00/03092, filed on Apr. 6, 2000.

(51) Int. Cl.[7] ..... F41A 3/86
(52) U.S. Cl. ..... 89/199
(58) Field of Search ..... 89/193, 194, 199; 42/76.02, 78

(56) References Cited

U.S. PATENT DOCUMENTS

| | | | | |
|---|---|---|---|---|
| 4,485,723 A | * | 12/1984 | Sarony | 89/163 |
| 4,754,689 A | * | 7/1988 | Grehl | 89/196 |
| 5,050,480 A | | 9/1991 | Knight, Jr. et al. | 89/147 |
| 5,127,310 A | | 7/1992 | Lishness et al. | 89/199 |
| 5,392,689 A | | 2/1995 | Buzzeo et al. | 89/196 |

FOREIGN PATENT DOCUMENTS

DE 35 41 173 A1 8/1986

OTHER PUBLICATIONS

*International Search Report* corresponding to International Patent Application Serial No. PCT/EP00/03092, European Patent Office, dated Aug. 16, 2000, 4 pages.
Translation of the *International Preliminary Examination Report* corresponding to International Patent Application Serial No. PCT/EP00/03092, European Patent Office, dated Aug. 3, 2001, 4 pages.

* cited by examiner

*Primary Examiner*—Michael J. Carone
*Assistant Examiner*—Troy Chambers
(74) *Attorney, Agent, or Firm*—Grossman & Flight LLC

(57) ABSTRACT

A spring closing assembly is disclosed which is adapted to be selectively installed and removed from a firearm. The illustrated spring closing assembly includes a rod having a free forward end which defines a slot dividing the free forward end into fork prongs. The assembly also includes a spring mounted on the rod, and a projecting part located on a first one of the fork prongs. At least the first fork prong is resiliently displaceable in an inward direction. The assembly also includes a washer dimensioned to be forced onto the free end of the rod by inwardly displacing the first fork prong. At least one of the projecting part and the washer is chamfered to promote the inward displacement of the first fork prong. The washer is captured between the projecting part and the spring.

10 Claims, 2 Drawing Sheets

CLOSING SPRING ASSEMBLY FOR A HANDGUN

RELATED APPLICATION

This patent arises from a continuation of International Application Ser. No. PCT/EP00/03092, which was filed on Apr. 6, 2000.

FIELD OF THE INVENTION

The invention relates generally to firearms, and, more particularly, to a closing spring assembly for a handgun.

BACKGROUND OF THE INVENTION

Reference is made to German Patent 437,959.

Prior closing spring assemblies must be removed when their associated handgun is dismantled. However, the spring centering rod should not itself be dismantled, or it should not be dismantled any further for the time being, because it is too difficult to reassemble the closing spring assembly. The closing spring assembly is usually held together inseparably by a locking washer which is pressed into a ring groove close to the free end of the rod where it is secured elastically. Such locking washers are included in DIN 6799, for example.

These locking washers serve only to hold the closing spring assembly together after it has been removed from the weapon. These locking washers do not have any other function. They do not absorb any forces when the assembly group is installed.

A typical example of such a closing spring assembly is the closing spring device of self-loading or automatic guns with a Colt-Browning safety lock. In such guns a catch piece is fixedly mounted on the rear end of a spring centering rod. A helical closing ring is pushed onto the rod itself. This is followed by a ring-shaped spring supporting plate or washer, which is referred to here in general as an assembly part. In the unloaded state, the spring is longer than the spring centering rod. As a result, assembly of the closing spring assembly is rather tricky. To facilitate assembly, a ring groove is provided in the forward end of the spring centering rod. A locking washer is positioned in the ring groove. When the closing spring assembly is removed from the weapon, the closing spring, when compressed slightly, presses the spring supporting plate against the locking washer, but it cannot slide down off the spring centering rod. When assembled, the closing spring assembly is inserted from beneath into the slides of the gun which already hold the barrel. The closing spring assembly is then pushed slightly forward and locked in the lock body at the end of the barrel. In this installed state, the closing spring is compressed slightly more than previously, so that the load on the locking washer is released.

However, it has been found that some locking washers break or come off during use of the gun. They evidently do not survive the vibration applied to the spring centering rod during firing. The function of the gun is not usually impaired, but it is much more difficult to reassemble the gun after breaking it down the next time after the washer has fallen off.

The locking washers that have broken or come off and the respective ring groove have of course been investigated and studied in detail, but no irregularities have been discovered. Therefore, the possibility has been considered that the customer might have removed the locking washer from the gun incorrectly, thereby damaging it and then inserting it again. However, inquiries with these customers have not confirmed this assumption.

Furthermore, there has also been an increased frequency of damage incidents involving the locking washers of specific manufacturers, although no reasonable generalization could be formulated to track down the cause of these damage incidents.

The simplest solution would be to include a bag of locking washers (a penny item) with each gun shipped. However, this would to some extent be equivalent to admitting that the gun shipped is damaged or at least not well designed, and, in any case, can create the impression that the weapon is not completely reliable. Since customers demand the greatest reliability, this idea has been discarded.

A retaining arrangement of the type described herein is known from U.S. Pat. No. 5,127,310, but it is described in a different context.

SUMMARY OF THE INVENTION

In accordance with an aspect of the invention, a spring closing assembly is provided which is adapted to be selectively installed and removed from a firearm. The spring closing assembly includes a rod having a free forward end; and an assembly part which is dimensioned to be pushed onto the rod. The assembly also includes at least one projecting part located in proximity to the free forward end of the rod. The at least one projecting part is displaced from a resting position when the assembly part is pushed onto the free forward end of the rod and thereafter returns to the resting position with the assembly part mounted on the rod The at least one projecting part is in retaining engagement with the assembly part when (a) the at least one projecting part is in the resting position, (b) the assembly part is mounted on the rod, and (c) the spring closing assembly is removed from the firearm.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
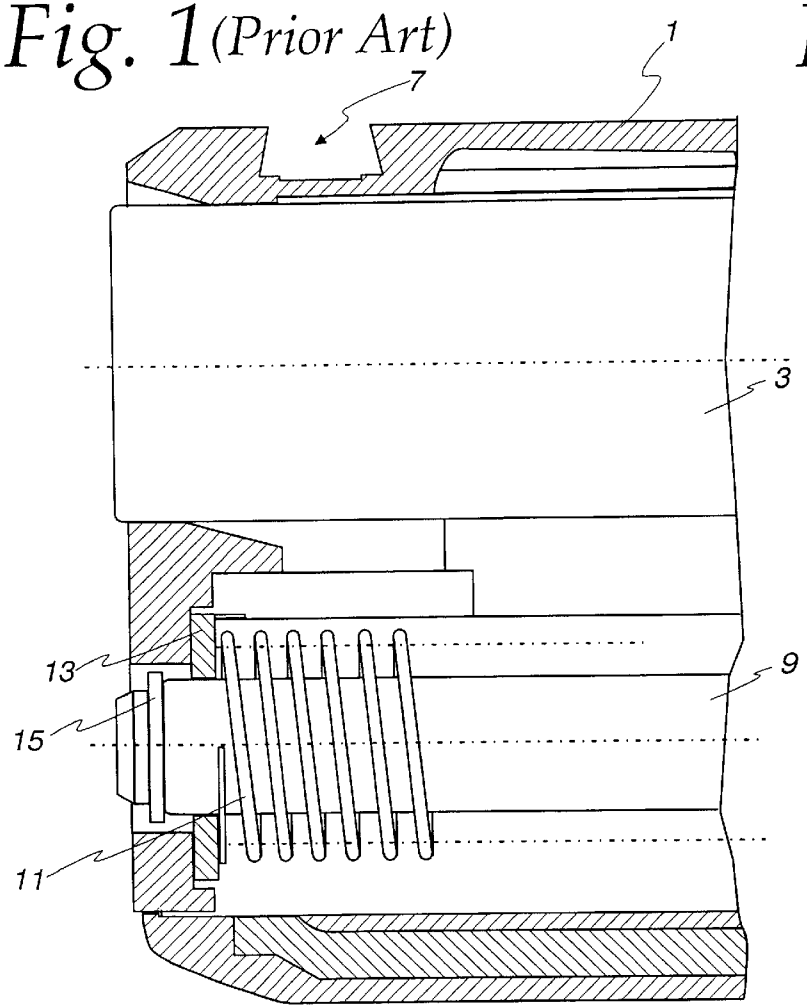
Fig. 1 (Prior Art)
FIG. 1 is a longitudinal sectional view through the front end of an automatic gun illustrating a closing spring assembly.

FIG. 1 is a longitudinal sectional view of the front part of an automatic gun with the safety on. The gun has a slide or a breech 1, a barrel 3 and a handle (not shown), all of which are conventional and will not be described further herein. A transverse groove 7 to accommodate a sight or the like is located at the forward end on the top side of the slide 1.

A known spring centering rod 9 is positioned beneath the barrel 3 and projects through a borehole in the forward end face of the slide 1. A helical closing spring 11 is pushed onto the rod 9 and is supported with its rear end (not shown) on an element which is stationary with respect to the handle, at least in the condition of the gun shown here (breech 1 closed and locked). The forward end of the closing spring 11 is supported on the breech 1 at the forward end by way of a ring washer 13 which sits with its bore tightly but displaceably on the rod 9.

A ring groove (not shown) is formed in the forward end of the rod 9. A locking washer 15 made of spring plate sits in this ring groove. The washer 15 and the groove it sits in are positioned at a location which sits with some play in the borehole in the forward end face of the slide 1 as shown in FIG. 1.

In the installed state shown here, the locking washer 15 is apparently completely unloaded. The closing spring assembly includes the rod 9, the closing spring 11, the ring washer 13 and the locking washer 15. When the closing spring assembly is removed, the closing spring 11 can relax slightly so that it is then supported on the locking washer 15 by way of the ring washer 13.

As already pointed out above, it occasionally happens that the locking washer 15 breaks or comes off of the rod 9. If the locking washer 15 is missing when the closing spring assembly is removed, the closing spring 11 pushes the ring washer 13 forward and down from the rod 9, so that this ring washer 13 can fall to the ground and be lost.

Figure 2:
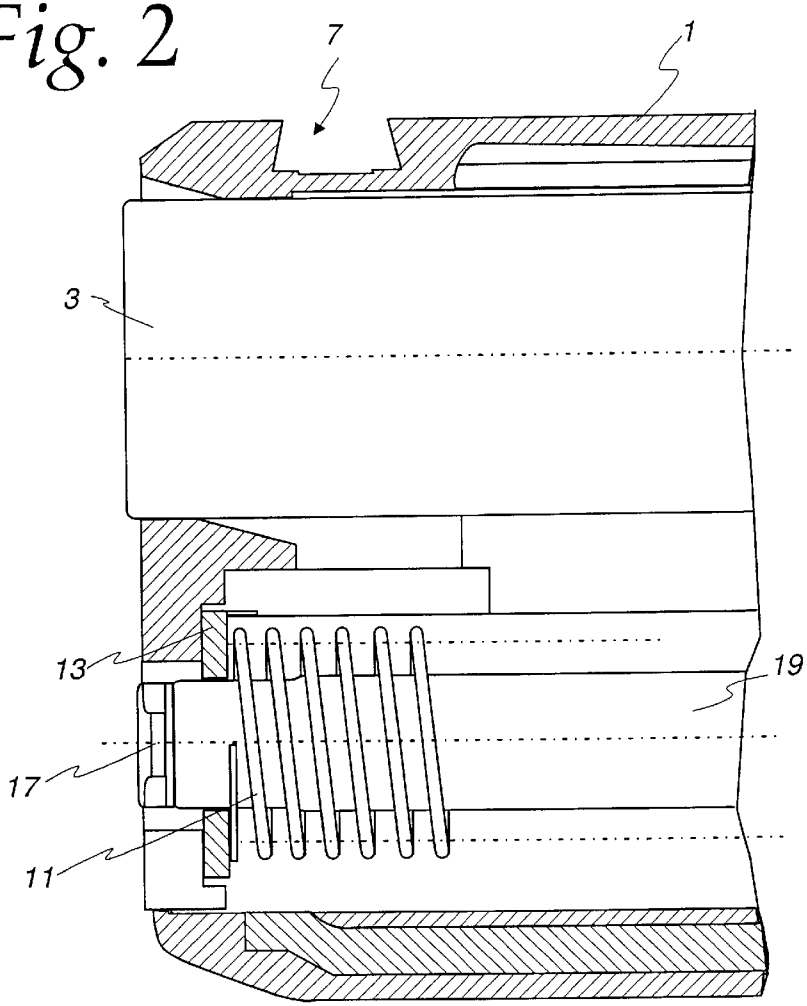
FIG.2 is a longitudinal sectional view like that shown in FIG. 1, but with a closing spring assembly constructed in accordance with the teachings of the invention.
Figure 3:
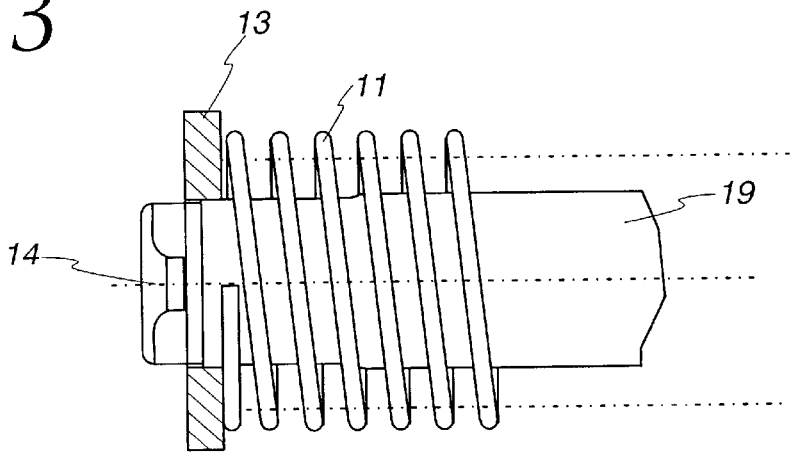
FIG. 3 is a truncated longitudinal sectional view of the closing spring assembly of FIG. 2.
Figure 4:
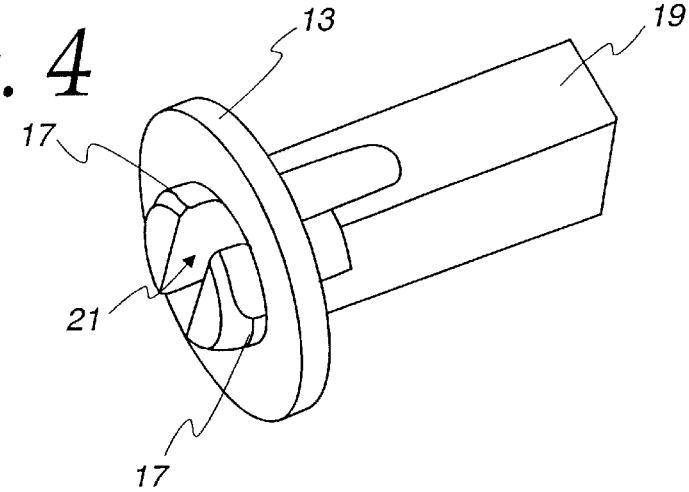
FIG. 4 illustrates a part of the closing spring assembly of FIG. 3, shown in an inclined view.
Figure 5:
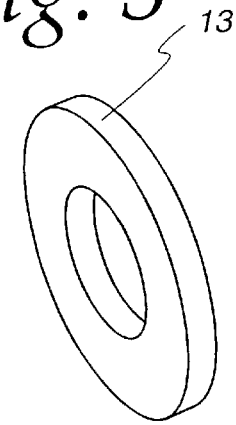
FIG. 5 illustrates the ring washer from the closing spring assembly of FIGS. 3 and 4.
Figure 6:
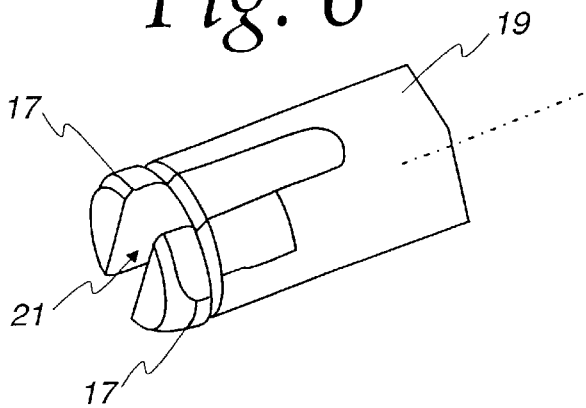
FIG. 6 illustrates the front part of the spring centering rod of the closing spring assembly of FIGS. 3 and 4, shown in an inclined and truncated view.

FIG. 2 illustrates a closing spring assembly constructed in accordance with the teaching of the invention. The illustrated assembly is shown installed in a handgun in FIG. 2. FIG. 3 shown the closing spring assembly of FIG. 1 removed from the weapon. FIGS. 4–6 show individual parts of the closing spring assembly of FIGS. 2 and 3. The parts that are identical in the exemplary closing spring assembly of FIGS. 2–6 and in the prior art closing spring assembly of FIG. 1 are labeled with the same reference numbers in all the figures. The spring centering rods are different, being labeled as "9" in the prior art assembly shown in FIG. 1 and as "19" in the assembly of FIGS. 2–6. In addition, the assembly of FIGS. 2–6 does not have a locking washer 15. Instead, the forward end of the rod 19 is provided with a longitudinal slot 21 which is arranged symmetrically with respect to the longitudinal axis of the rod 19. The slot 21 passes through the entire width of the rod 19. The length of the slot is approximately 1.5 times the diameter of the rod 19. The height of the slot 21 is approximately one third of the diameter of the rod 19 as shown in FIGS. 4 and 6.

Projecting parts 17 are formed on the outside of the rod 19. The projecting parts 17 are integrally formed with the rod 19 and are symmetrically located on both sides of the slot 21. Each projecting part 17 is chamfered on the side facing the free end of the rod 19. On the opposite end, however, each projecting part 17 not only drops steeply and at a right angle, but also opens at the base into a shallow ring groove in the surface of the rod 19 to permit the usual rounded transition between adjacent surfaces. FIG. 6 shows the design of the rod 19 in detail.

FIGS. 3 and 4 show the end of the rod 19 with the ring washer 13 and the closing spring 11 with the assembly removed from the weapon (i.e., the dismantled state). In this state, the washer 13 is pressed by the closing spring 11 against the projecting parts 17 and is in contact with them. In FIG. 4, the closing spring 11 has been omitted so that the other assembly parts can be illustrated better. FIG. 5 shows the ring washer 13 alone.

As shown in FIG. 4, the free end of the rod 19 projecting above the ring washer 13 is very short, so that it cannot be easily clamped in a vise by an amateur hobbyist and compressed to remove the washer 13. Without the washer 13, the gun would probably not function as smoothly. The rod 19 would not be guided in that case. However, the manufacturer would be blamed for any resulting malfunction instead of blaming the hobbyist who did not assemble the gun properly.

As shown by a comparison of FIGS. 1 and 2, when the assemblies of FIGS. 1 and 2 are installed in their weapons, none of the parts of the closing spring assembly of FIG. 2 is arranged in the location where the locking washer 15 is mounted in the assembly of FIG. 1. Therefore, nothing can be broken at that location.

From the foregoing, persons of ordinary skill in the art will appreciate that the closing spring assembly of FIG. 2 will hold together more reliably when removed from the weapon than other devices. To this end, at least one projecting part 17 is arranged or designed on the rod 19, so that this projecting part yields when the washer 13 is pushed onto the rod 19, but then returns to its resting position, where it is in locked engagement with the washer 13 when the closing spring assembly is removed. Such a retaining arrangement is known from U.S. Pat. No. 5,127,310, although it is described in a different context there.

The locking washer 15 and the receiving groove are omitted in the closing spring assembly of FIGS. 2–6 and are replaced by projecting parts 17 which are biased outward in the radial direction. In its resting position (the outermost position radially), the suitably designed and dimensioned projecting parts 17 optionally engage with the washer 13 to prevent the washer 13 from slipping off the rod 19. However, the resiliency of the projecting parts 17 allow them to be inwardly displaced such that the ring washer 15 can be pushed over the projecting parts 17 onto the rod 19 or pulled down from it.

Experiments have shown the stability of the closing assembly of FIGS. 2–6, although ultimately it is not known precisely why the previous locking washers 15 would break and now the projecting parts 17 hold.

It is conceivably possible to press the projecting part or parts 17 radially inward in a mounting device, for example, and then push the washer 13 over it. To facilitate assembly of the closing spring assembly, however, the following is proposed. The surface of the projecting part or parts 17 facing the free end of the rod 19 and/or the surface pointing in the direction of movement when the ring washer 13 is pushed onto the rod 17 should be chamfered so that the projecting part 17 is pressed in radially when preferably one inclined face of the washer 13 is pushed onto the preferably chamfered projecting part 17. However, the other two surfaces of the washer 13 and the projecting part 17, (i.e., the surfaces facing away from one another before assembly), should be designed so that they can be supported on one another.

The projecting part 17 may be designed as a pin, for example, which is arranged so that it is radially movable near the free end of the rod 19, and is pressed inward to the extent that it is depressed completely into the rod 19. It is advantageous, however, for a longitudinal slot 21 to be provided in the rod 19. This slot 21 starts at the free end and runs in parallel with the longitudinal axis of the rod 19 over a short section of the rod 19. The slot 21 preferably extends across the rod 19, preferably diametrically through it.

The end of the rod 19 is, thus, forked. The material of this rod 19 and the dimensions of the slot 21 are designed so that the fork prongs can be pressed together elastically, starting from their resting positions, but they return to their resting positions again after being released.

The projecting part 17 sits on the outside of at least one of the fork prongs. This projecting part is fixedly connected to the rod 19 and may be, for example, a grooved dowel pin that is pounded in. Alternatively, it may also be designed in one piece with the rod 19. This latter solution has the advantage over the related art that the total number of assembly parts is reduced (eliminating the locking ring or the grooved dowel pin).

Two opposing projecting parts 17 arranged symmetrically with respect to the longitudinal slot 21 are preferred. However, it is also possible for just one such projecting part to be provided.

The rod 19 is preferably a spring centering rod on which sits the closing spring of a gun. The free end of the spring is close to the end of the spring guide rod. This closing spring is supported on a ring washer 13 as an abutment. This ring washer 13 forms an assembly part which is held by the projecting part(s) 17 against the force of the closing spring when the closing spring assembly is removed from the weapon.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A spring closing assembly which is adapted to be selectively installed and removed from a firearm, the spring closing assembly comprising:

a rod having a free forward end, the free forward end being dimensioned to project into a borehole in a forward end face of a slide of the firearm when the spring closing assembly is installed in the firearm;

a ring washer which is dimensioned to be pushed onto the free forward end of the rod and to be positioned adjacent the borehole when the spring closing assembly is installed in the firearm; and at least one projecting part located in proximity to the free forward end of the rod adjacent the forward end face of the slide of the firearm when the spring closing assembly is installed in the firearm, wherein the at least one projecting part is displaced from a resting position when the ring washer is pushed onto the free forward end of the rod and thereafter returns to the resting position with the ring washer mounted on the rod, wherein the at least one projecting part is in retaining engagement with the ring washer when (a) the at least one projecting part is in the resting position, (b) the ring washer is mounted on the rod, and (c) the spring closing assembly is removed from the firearm.

2. An assembly as defined in claim 1, wherein a side of the at least one projecting part facing the free forward end of the rod is chamfered.

3. An assembly as defined in claim 1, wherein a side of the ring washer which faces the projecting part before pushing the assembly part onto the rod is chamfered.

4. An assembly as defined in claim 1, wherein the free forward end of the rod has a longitudinal slot.

5. An assembly as defined in claim 4, wherein at least one of the at least one projecting part is located at a point of intersection of: (1) an outer circumference of the rod and (2) a straight line intersecting a longitudinal axis of the rod and running perpendicular to the slot.

6. An assembly as defined in claim 1, further comprising a helical spring which is pushed onto the rod before the ring washer.

7. An assembly as defined in claim 6, wherein the ring washer prevents the helical spring from moving past the free forward end of the rod.

8. A spring closing assembly which is adapted to be selectively installed and removed from a firearm, the spring closing assembly comprising:

a rod having a free forward end, the free forward end including a slot dividing the free forward end into at least two fork prongs, the free forward end being dimensioned to project into a borehole in a forward end face of a slide of the firearm when the spring closing assembly is installed in the firearm;

a spring mounted on the rod;

a projecting part located on a first one of the at least two fork prongs, the first fork prong being resiliently displaceable in an inward direction; and a washer dimensioned to be forced onto the free end of the rod by inwardly displacing the first fork prong, wherein at least one of the projecting part and the washer is chamfered to promote the inward displacement of the first fork prong, and wherein the washer is captured adjacent the borehole between the projecting part and the spring when the spring closing assembly is installed in the firearm.

9. An assembly as defined in claim 8 wherein, when the spring closing assembly is mounted in the firearm, the washer is separated a distance from the projecting part, but engages the spring, and when the spring closing assembly is removed from the firearm, the washer engages the projecting part and the spring.

10. A method of assembling a spring closing assembly comprising:

providing a rod having a forked free end with a projecting part located on at least one prong of the forked free end, the free forked end being dimensioned to project into a borehole in a forward end face of a slide of a firearm when the spring closing assembly is installed in the firearm;

positioning a spring on the rod;

initially pushing a washer on to the forked free end of the rod such that the projecting part is inwardly displaced;

continuing to push the washer until the washer moves past the projecting part, the projecting part returns to a rest position, and the washer is captured adjacent the borehole between the projecting part and the spring when the spring closing assembly is installed in the firearm.

* * * * *